United States Patent [19]

Green

[11] Patent Number: 4,570,099

[45] Date of Patent: Feb. 11, 1986

[54] THERMIONIC ELECTRON EMITTERS

[75] Inventor: Michael C. Green, Mountain View, Calif.

[73] Assignee: E M I-Varian Limited, Hayes, England

[21] Appl. No.: 660,248

[22] Filed: Oct. 12, 1984

Related U.S. Application Data

[63] Continuation of Ser. No. 123,575, Feb. 22, 1980, abandoned.

[30] Foreign Application Priority Data

May 29, 1979 [GB] United Kingdom ..... 7918610

[51] Int. Cl.[4] ..... H01J 1/14; H01J 19/06; H01K 1/04

[52] U.S. Cl. ..... 313/346 R; 313/346 DC; 313/337

[58] Field of Search ..... 313/346, 346 DC, 337, 313/346 R

[56] References Cited

U.S. PATENT DOCUMENTS

| | | | |
|---|---|---|---|
| 2,902,620 | 9/1959 | Winter | 313/346 |
| 3,155,864 | 11/1964 | Coppola | 313/346 R |
| 3,243,637 | 3/1966 | Affleck, III | 313/346 R |
| 3,373,307 | 3/1968 | Zalm et al. | 313/346 R |
| 3,437,865 | 4/1969 | Gabor et al. | 313/346 |
| 3,454,816 | 7/1969 | Hoffmann | 313/346 R |
| 3,497,757 | 2/1970 | Zalm et al. | 313/346 R |
| 3,625,759 | 12/1971 | Williams | 313/346 |
| 3,692,575 | 9/1972 | Nestler | 313/346 DC |
| 3,842,309 | 10/1974 | Van Stratum et al. | 313/346 R |
| 4,019,081 | 4/1977 | Buxbaum et al. | 313/346 DC |
| 4,165,473 | 8/1979 | Falce | 313/346 R |
| 4,274,030 | 6/1981 | Buxbaum | 313/346 R |
| 4,393,328 | 7/1983 | Shroff et al. | 313/346 R |

*Primary Examiner*—Saxfield Chatmon

*Attorney, Agent, or Firm*—Fleit, Jacobson, Cohn & Price

[57] ABSTRACT

A thermionic cathode (FIG. 1) comprises an emitter (3) comprising a matrix (4) of tungsten impregnated with an alkaline earth activator. The matrix is coated with a coating (5) of about 20–30% osmium fully alloyed with tungsten formed by cosputtering osmium and tungsten onto the matrix. A diffusion barrier (6) of osmium may be interposed between the matrix 4 and coating (5) (FIG. 2) and, optionally, osmium may be diffused into the matrix (4). Alternatively the whole matrix may comprise a mixture of about 20–30% osmium fully alloyed with tungsten (FIG. 3). Alternative to osmium and tungsten may be used, and various modifications may be made, and other methods of making the emitter may be used. In particular the proportion of osmium may be about 40%.

27 Claims, 5 Drawing Figures

THERMIONIC ELECTRON EMITTERS

Figures 1, 2, 3:
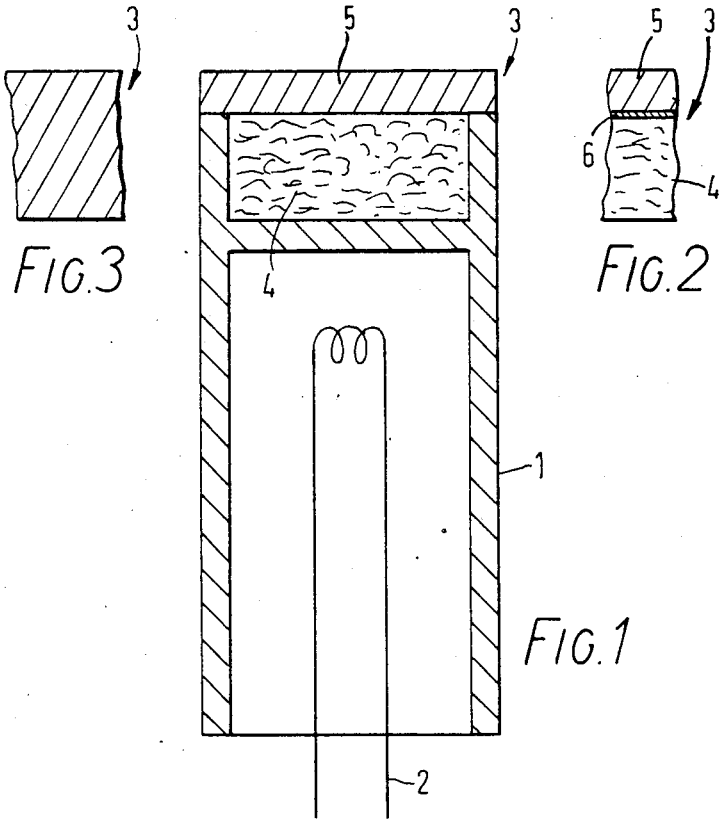

This application is a continuation of application Ser. No. 123,575, filed 2/22/80, abandoned.

The present invention relates to thermionic electron emitters.

A thermionic cathode, now known as "M"-type, is disclosed in U.S. Pat. No. 3,373,307. This cathode is a dispenser cathode which comprises a refractory metal matrix of tungsten (W) or tungsten-molybdenum in reactive relationship with an alkaline earth metal compound which supplies free barium or barium oxide to the emitting surface of the matrix. A thin porous coating of a refractory metal having a work function higher than that of tungsten covers the emitting surface. The coating may be sputtered on. The coating metal is selected from the group of osmium, iridium, ruthenium, and rhenium. The resultant cathode exhibits increased electron emission at the same temperature, or the same electron emission at a lower temperature, than that of a comparable cathode without the layer. Generally osmium (Os) is preferred as the coating metal.

Although the 'M' type cathode has been known for many years there has been no satisfactory explanation or understanding of how the coating increases emission. Despite this, developments of it have occurred.

In the development disclosed in U.S. Pat. No. 3,497,757 the coating is a thin porous layer of an alloy of osmium and iridium or osmium and ruthenium to provide longer cathode lifetime and, less danger during manufacture, (osmium being readily oxidisable to an extremely toxic oxide). This coating is sputtered on.

In an article entitled "Tracer Study on the Decrease of Emission Density of Osmium-Coated Impregnated Cathodes" by A. J. A. Van Stratum and P. N. Kuin, Journal of Applied Physics Vol. 42 Number 11, October 1971, it is considered that the decrease of emission density with life is caused by a reaction between tungsten and osmium resulting in the formation of an $OsW_2$ alloy. The formation is accelerated by increasing the cathode temperature.

Another development of the 'M'-type cathode is described in an article entitled "Surface and Emission Characteristics of the Impregnated Dispenser Cathode" (Jones, MacNealy, and Swanson) in "Applications of Surface Science 2 (1979)" pages 232–257, North-Holland Publishing Company. This development is an IDC (impregnated dispenser cathode) made by Spectra-Mat Inc. of Watsonville, Calif., USA. This cathode has a sputter coating of Osmium-Ruthenium alloy, the coating having a random columnar structure. In the article the improved emission of this cathode is attributed, at least in part, to the geometric form of the surface structure.

British Pat. No. 1,425,582 discloses a method of making an M-type cathode having a porous metal body in which the dangers of osmium are reduced. The method comprises the steps of forming a reducible impregnation mixture of at least one alkaline earth compound and a compound of another metal (e.g. osmium) having a higher work function than the porous metal of the body, and impregnating the porous metal body (e.g. tungsten) using the mixture and a reducing atmosphere whereby said another metal is released from its compound. Preferably, the mixture is placed on the structure and heated in the reducing atmosphere. The osmium is released in a finely divided state.

British Pat. No. 1,143,865 discloses a dispenser cathode called an MK cathode which is made by a method wherein a tungsten plate is first etched in an aqueous hydrogen peroxide/ammonia solution and rinsed with deionised water, the emissive surface of said plate is thereafter treated with an approximately 2% aqueous solution of $OsO_4$ and the grey to deep black deposit forming after a few minutes is, after thorough washing, reduced and sintered on to said plate by heating at 1200° C. for about 15 minutes in an atmosphere of hydrogen. This results in the tungsten plate being coated with Osmium.

However, as stated in British Pat. No. 1,240,050, a cathode made in this way, did not provide the reduction in operating temperature that was expected, except by the prohibitively expensive processing of ageing the cathode for up to 500 hours. In the development disclosed in Pat. No. 1,240,050 the ageing time is reduced by annealing the cathode "at a temperature of 1200° C.±200° C. for a time sufficient to ensure substantially complete conversion of said layer to an alloy containing about 70 atom% osmium and 30 atom % tungsten."

German Offenlegungsschrift No. 27 27187 (corresponding to U.S. Pat. No. 4,165,473—Varian Associates) discloses a type of thermionic cathode different to "M"-type, and referred to hereinafter as "mixed matrix" type. A preferred example of this cathode comprises particles of pure iridium mixed in fixed proportions with particles of pure tungsten. The particles are sintered together to form a continuous porous matrix. The matrix is filled with an active material in the form of an alkaline earth aluminate. The iridium and tungsten form an alloy, but for optimal results the alloy formation must be incomplete. The emission of such a cathode is greater than that of an 'M'-type cathode, The optimum proportions of iridium and tungsten are 20% iridium and 80% tungsten. The iridium and tungsten mixture may be replaced by pure iridium, osmium, ruthenium, or rhenium or mixtures thereof or by a mixture of tungsten and one of those metals.

It has been found in experiments at EMI-Varian Ltd. on the mixed matrix cathode that, if the matrix comprises a mixture of osmium and tungsten (20–30% Os, 80–70% W) emission is initially less than that of an equivalent 'M'-type cathode, but enhances to a maximum which occurs after 500 hours and is then superior to that of the iridium mixed matrix.

It is an object of the present invention to provide a thermionic electron emitter which provides enhanced emission compared to an 'M'-type cathode at the same temperature or the same emission at a lower temperature, and which does not require to be aged before enhanced emission is achieved.

According to one aspect of the invention, there is provided a thermionic electron emitter including: material comprising about 15 to 45% of a first metal selected from the group consisting of osmium, iridium, ruthenium, rhodium, rhenium and alloys thereof, fully alloyed with 85 to 55% of a second metal selected from the group consisting of tungsten, molybdenum and alloys thereof; and an alkaline earth activator.

According to another aspect, there is provided a method of making a thermionic electron emitter comprising fully alloying 15 to 45% of a first metal selected from the group consisting of osmium, iridium, ruthenium, rhodium, rhenium and alloys thereof, with 85 to 55% of a second metal selected from the group consisting of tungsten molybdenum and alloys thereof, and incorporating the fully alloyed metals in the emitter with an alkaline earth activator.

In an embodiment, the emitter comprises about 20 to 30% of the first metal and about 80 to 70% of the second metal.

In another embodiment the emitter comprises about 40% of the first metal and about 60% of the second metal. However, due to the fact that, to reduce the effect on diffusion of the first metal, its proportion may be increased, the preferred amounts may be departed from in practice deliberately to achieve enhanced life.

In a preferred embodiment, the first metal comprises osmium and the second metal tungsten.

In an embodiment the activator comprises a mixture of barium oxide or carbonate, an oxide or carbonate of an alkaline earth metal other than barium, and at least one of aluminium oxide and boron oxide. The metal other than barium may be strontium or magnesium or mixtures of barium strontium and magnesium.

Figure 4:
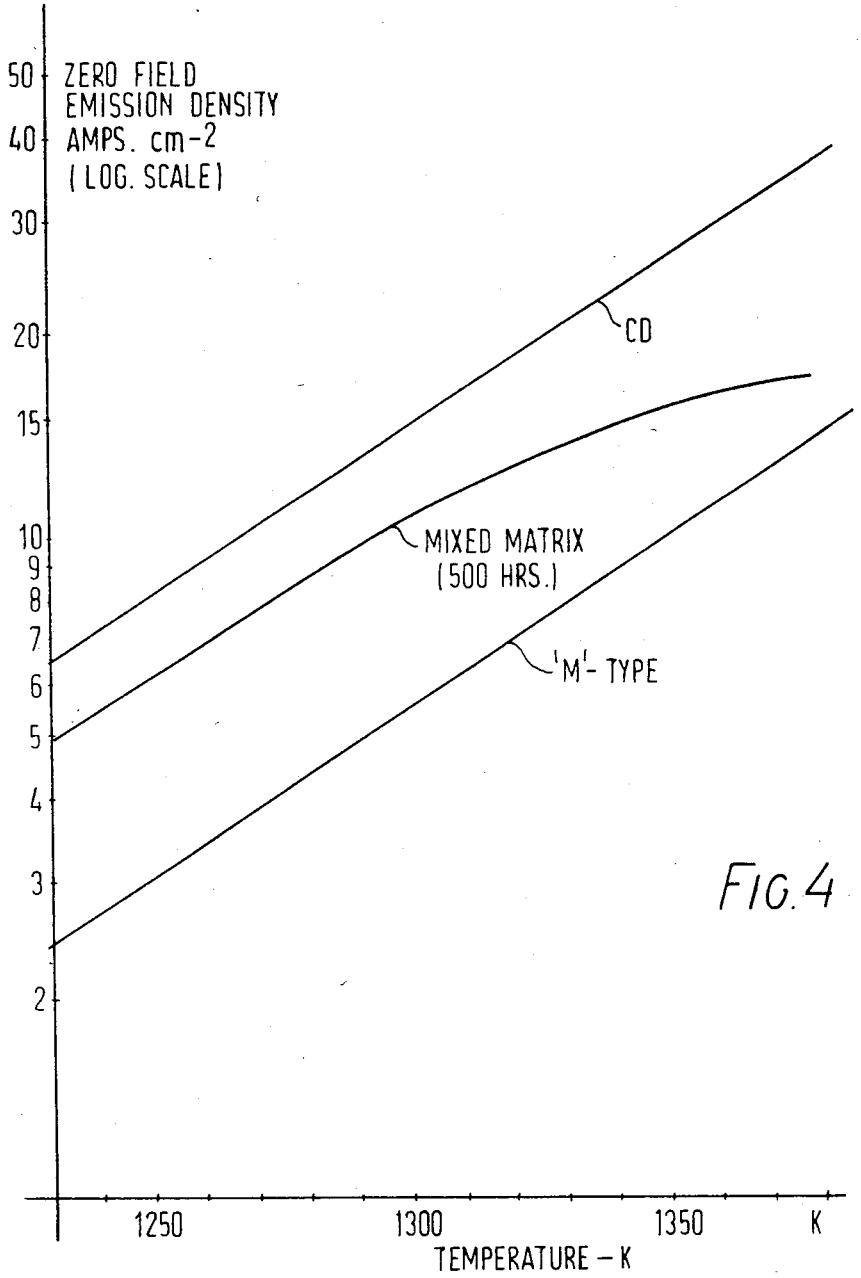
Figure 5:
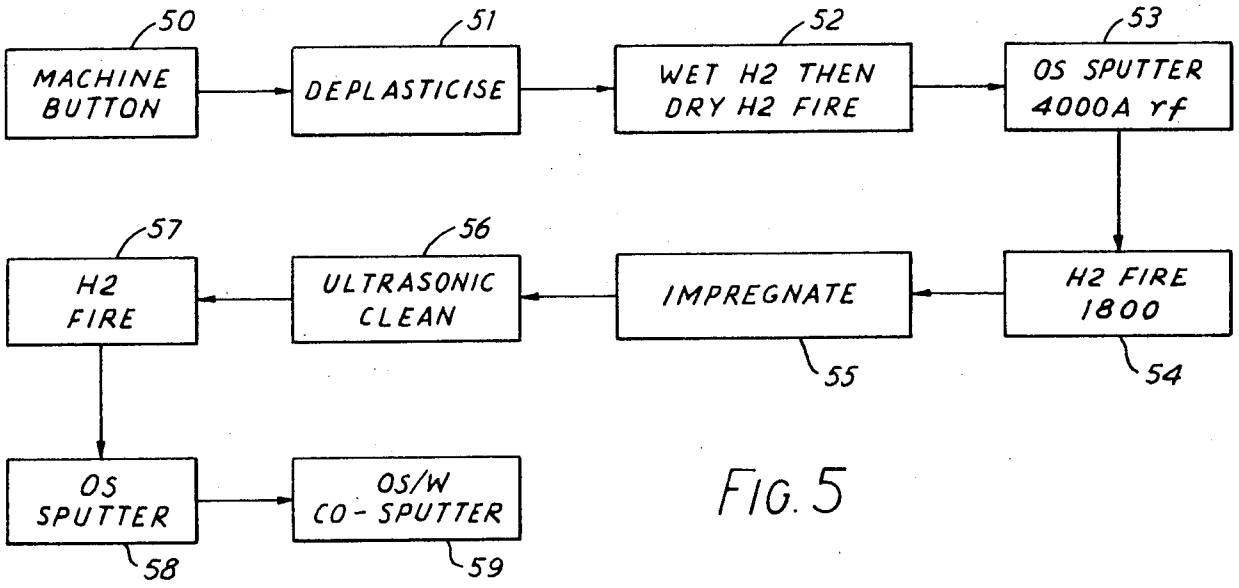

For a better understanding of the present invention, reference will now be made, by way of example, to the accompanying drawings, in which:

FIG. 1 is a section through a preferred thermionic cathode in accordance with the invention, FIG. 2 shows a detail of a modification of the preferred cathode in accordance with the invention, FIG. 3 shows part of another cathode in accordance with the invention, FIG. 4 is a graph of zero field emission density versus temperature comparing a cathode in accordance with the invention with other types of cathode, and FIG. 5 is a schematic diagram of a method of manufacturing a further cathode in accordance with the invention.

Referring to FIG. 1, the cathode comprises a molybdenum tube 1 containing in a lower cavity a heater 2, and in an upper cavity a thermionic emitter 3. The emitter 3 comprises: a porous matrix 4 of tungsten impregnated with an activator in the form of a mixture of barium oxide, aluminium oxide, and calcium oxide in the molecular proportions 3:1:½ respectively; and a coating 5 on the free surface of the matrix.

In accordance with the invention, in this example thereof, the coating 5 comprises a fully alloyed combination of osmium and tungsten having the proportions of about 20 to 30% osmium and 80 to 70% tungsten.

The coating in this example is formed by co-sputtering osmium and tungsten in the desired proportions onto the impregnated matrix. The coating is 4000 Å thick in this example, but it may have a thickness in the range 2000 to 15000 Å.

In operation, at the temperatures necessary for high current densities e.g. $>10$ $Acm^{-2}$ the osmium concentration will be lowered by diffusion into the matrix 4. The effect of this may be reduced by initially forming the coating with a greater proportion of osmium than quoted above. Alternatively, as shown in FIG. 2, a thin interlayer 6 of pure osmium could be placed between the coating 5 and the matrix 4. In another alternative, the impregnant is doped with one precent or less of osmium to counteract the diffusion of osmium into the matrix. This is achieved by using the method of forming an impregnated 'M'-type cathode disclosed in British Pat. No. 1,425,582 using 1% or less of osmium. Once the impregnated matrix is formed, the fully alloyed osmium/tungsten coating is formed on it.

Instead of co-sputtering, the coating may be formed by coevaporating the metals osmium and tungsten onto the matrix 4. This is done by directing an electron beam onto targets of osmium and tungsten to cause the metals to evaporate from the targets onto the matrix. The coating could also be formed by co-precipitating the metals onto the matrix from reducible compounds thereof.

In another cathode in accordance with the invention, (FIG. 3) the whole emitter 3 comprises a fully alloyed mixture of osmium and tungsten in the approximate proportions 20 to 30% osmium and 80 to 70% tungsten, impregnated with an alkaline earth aluminate. The emitter of FIG. 3 is made for example by:

(i) pressing a mixture of the powdered metals in the desired proportions (at for example 10 tons or 20,000 pounds per square inch);

(ii) sintering to give a 20% porous matrix (e.g. at 2500° C. for 30 mins)

(iii) furnacing at a temperature and for a time to enable full osmium/tungsten interdiffusion to occur during furnacing, (e.g. at a temperature in the range 1800° to 2000° C. for 5 to 10 hrs). and (iv) impregnating the resultant porous matrix with the alkaline earth aluminate, for instance barium oxide, aluminium oxide and calcium oxide in the molecular proportions 3:1:½ respectively.

An alternative method of making the emitter of FIG. 3 comprises (i) pressing powder of fully alloyed osmium/tungsten having the approximate proportions of 20 to 30% osmium and 80 to 70% tungsten (e.g. at 20,000 psi);

(ii) sintering to give a 20% porous matrix (e.g. at 2500° C. for 30 mins); and (iii) impregnating the resultant porous matrix with alkaline earth aluminate, for instance barium oxide, aluminium oxide and calcium oxide in the molecular proportions 3:1:½ respectively.

The materials used in the specific examples given hereinbefore have been restricted to fully alloyed osmium and tungsten, in the approximate proportions 20–30% osmium and 80–70% tungsten and impregnant in the form of barium oxide, aluminium oxide and calcium oxide in the molecular proportions 3:1:½. However, various modifications to these proportions may be made, and furthermore different materials may be used. For instance an embodiment of the cathode shown in FIG. 1 has been made with a coating 5 comprising about 40% osmium and 60% tungsten, and as has been stated, the proportion of osmium may be increased by a few percent to reduce the effect of diffusion.

Instead of osmium there may be used iridium, ruthenium, rhodium or rhenium. Furthermore alloys of any two or more of osmium, iridium, ruthenium, rhodium and rhenium may be used. Instead of tungsten, there may be used molybdenum or an alloy of tungsten and molybdenum. The proportions of the replacements of osmium and tungsten would be the same as those for osmium and tungsten as described hereinbefore.

The impregnant may have the form described hereinbefore but in other proportions such as 4:1:1 or 5:2:3. Furthermore, instead of calcium oxide, another oxide of an alkaline earth metal other than barium may be used, and instead of aluminium oxide there may be used boron oxide. The metal other than barium may be strontium or magnesium or a mixture of any two or more of calcium, strontium and magnesium. Furthermore, instead of oxides of the alkaline earth metal other than barium, compounds which decompose on heating to oxides e.g. carbonates of those metals may be used.

There has been described with reference to FIG. 2 the provision of a layer 6 of osmium between the coating 5 and the matrix 4. The layer 6 acts as a diffusion barrier to reduce the diffusion of osmium from the coating 5 into the matrix. Another alternative is to dope the impregnant with osmium as described above. FIG. 5 describes the manufacture of a further cathode in which yet another manner of reducing diffusion is provided.

Referring to FIG. 5, a porous matrix of tungsten is impregnated with filler e.g. a plastics material to enable it to be machined (50) and then the filler is at least partially removed by firing in air (51). The button is then subjected to wet hydrogen at a temperature of 1000° to remove (by oxidation) remnants of the filler followed by dry hydrogen at 1800° C. to produce reducing conditions (52). Osmium is then sputtered onto the matrix to form a coating 4000 Å thick (53). The button is then heated in a hydrogen atmosphere at 1800° C. for, for example, one hour to allow the osmium coating to diffuse into the matrix (54). The matrix is then impregnated with activator, e.g. barium calcium aluminate (55), cleaned ultrasonically (56) fired in a hydrogen atmosphere at a temperature of e.g. 1000° C. for e.g. 2 to 5 minutes (57). A layer of osmium, corresponding to the layer 6 of FIG. 2 is then sputtered on (58) followed by the co-sputtering of Osmium and tungsten to form a fully alloyed layer of about 15 to 45% osmium and 85 to 55% tungsten, corresponding to layer 5 of FIG. 2(59).

Steps 50 to 52 and 55 to 59 form the processing steps of a cathode as shown in FIG. 2. The extra steps 53 and 54 in which a further layer of osmium is provided and diffused into the matrix provide additional stabilisation of the surface layers, especially against surface diffusion.

The inventor of the present invention believes that the cathodes in accordance with the present invention operate in the manner described hereinafter although this is not proven. The explanation is given in terms of osmium, barium and tungsten.

Cathodes operate at about 1000° C. and at such temperatures osmium is not (as had previously been assumed by workers in the art) chemically inert but reacts with barium oxide to form a barium osmate compound. The limiting case of such a compound, of which probably only lower valent precursors exist in cathode surface conditions, is $Ba_3OsO_6$, formed as follows:

$$6\,BaO + Os \xrightarrow{1000^\circ\,C.} Ba_3OsO_6 + 3\,Ba.$$

In the osmate $Ba_3O_s{}^{VI}O_6$ and all its lower valent precursors, the transition metal d-orbitals are populated, for example $Os^{VI}$ being a $d^2$ system. These components have partially filled d-levels and are a natural "oxide bronze" analogous to the well known tungsten bronzes. The chemically combined osmium may be regarded as acting as a semiconductor "dopant"; its populated d-orbitals acting as the donor levels which give rise to n-type semiconduction. (In fact the concentration of osmium in cathodes is enormously higher than that used in conventional semiconductor doping).

When chemically combined in a crystal lattice with barium oxide, the osmium affects the electronic structure which determines conductivity and work function.

In the normal M-type cathode the continuous film of osmium is too readily available to react with the BaO emissive layer and chemically saturates it. This is non-optimum as excess BaO is necessary to form the particular osmate component with the best electronic structure for lowest work function. In order to achieve an optimum chemically combined osmium concentration in the emissive surface the relative rates of supply of osmium metal and barium oxide must be in the correct ratio. In the cathodes in accordance with the invention the desired osmium concentration in the emissive layer is less than saturation, and so the reaction rate of osmium with BaO must be controlled over the entire cathode surface. This control is achieved in accordance with the invention by fully alloying the osmium with the tungsten. This reduces the chemical potential of the osmium. Since the rate of reaction of osmium with barium oxide and the rate of barium oxide dispensation to the surface are both temperature dependent, the exact alloy composition, which gives rise to optimum doping of the emissive film varies with the operating temperature of the cathode which in turn depends on design operating current density.

In accordance with this explanation alloy compositions which provide optimum doping at appropriate temperatures lie in the range of approximately 20 to 40% osmium in tungsten.

In summary, in a cathode in accordance with the invention, according to this explanation, osmium doping is controlled to maximise emission. Such a cathode may thus be called a controlled doping (CD) cathode.

FIG. 4 compares the performance of an example of a controlled doping cathode with an 'M'-type cathode, and with a mixed-matrix type cathode.

The mixed-matrix cathode comprised a matrix of osmium and tungsten which was aged for 500 hrs to maximise its emission before the comparison was made. Its emission density is greater than that of an osmium coated 'M'-type cathode. However, as shown the CD cathode (which was as described with reference to FIG. 1) gives an even greater emission density and without the need for a substantial ageing process, full emission being given almost immediately. Instead of operating the CD cathode to produce enhanced emission as compared with the M-type or mixed matrise-type cathode at the same temperature, it could be operated to give the same emission but at a lower temperature with a much longer life-time.

What we claim is:

1. A thermionic emitter comprising:

a porous body of metal selected from the group consisting of tungsten, molybdenum and alloys thereof;

an emissive surface layer of a fully alloyed material being a coating on said porous body;

said fully alloyed material consisting solely of 15 to 45% of a first metal selected from the group consisting of osmium, iridium, ruthenium, rhodium, rhenium and alloys thereof, fully alloyed with 85 to 55% of a second metal selected from the group consisting of tungsten, molybdenum and alloys thereof, such that said fully alloyed material has said first metal and said second metal substantially fully interdiffused therein; and, an alkaline earth activator dispersed within said porous body.

2. A thermionic emitter according to claim 1 wherein said activator comprises a mixture of barium oxide or a compound of barium which decomposes on heating to the oxide, an oxide or compound which decomposes on heating to the oxide of an alkaline earth metal other than barium, and at least one of aluminium oxide and boron oxide.

3. A thermionic emitter according to claim 2, wherein the said alkaline earth metal other than barium comprises a metal selected from the group of calcium, strontium and magnesium.

4. A thermionic emitter according to claim 1, wherein a layer is interposed between said coating and said porous body, the layer composed of said first metal.

5. A thermionic emitter according to claim 4, further comprising said first metal diffused into the said porous body.

6. A thermionic emitter according to claim 1, wherein the activator further comprises 1% or less of the said first metal.

7. A thermionic emitter according to claim 1, wherein the said fully alloyed material comprises about 30% to 20% of said first metal fully alloyed with about 70% to 80% of said second metal.

8. A thermionic emitter according to claim 1, wherein said fully alloyed material comprises about 35% to 45% of said first metal fully alloyed with about 65% to 55% of said second metal.

9. A thermionic emitter according to claim 1, wherein said first metal comprises osmium and said second metal comprises tungsten.

10. A thermionic emitter comprising:

a porous body formed of a fully alloyed material;

said fully alloyed material consisting solely of 15 to 45% of a first metal selected from the group consisting of osmium, iridium, ruthenium, rhodium, rhenium and alloys thereof, fully alloyed with 85 to 55% of a second metal selected from the group consisting of tungsten, molybdenum and alloys thereof, such that said fully alloyed material has said first metal and said second metal substantially fully interdiffused therein; and, an alkaline earth activator dispersed within said porous body.

11. A method of making a thermionic electron emitter comprising the steps of:

providing a first metal selected from the group consisting of osmium, iridium, ruthenium, rhodium, rhenium and alloys thereof and a second metal selected from the group consisting of tungsten, molybdenum and alloys thereof, providing a porous body;

fully alloying said first and second metals to form at least an emissive surface layer on said porous body as a fully alloyed material consisting solely of 15 to 45% of said first metal and about 85 to 55% of said second metal, such that said fully alloyed material has said first and said second metal substantially interdiffused therein; and incorporating an alkaline earth activator in said porous body.

12. A method according to claim 11, wherein the activator comprises a mixture of barium oxide a compound of barium which decomposes on heating to the oxide, an oxide or compound which decomposes on heating to the oxide of an alkaline earth metal other than barium, and at least one of aluminium oxide and boron oxide.

13. A method according to claim 12, wherein the said metal other than barium comprises a metal selected from the group of calcium, strontium and magnesium.

14. A method according to claim 11, wherein the proportions of the selected metals are about 65 to 55% of said second metal and about 35 to 45% of said first metal.

15. A method according to claim 11, wherein the proportions of the selected metals are about 70 to 80% of said second metal and about 30 to 20% of said first metal.

16. A method according to claim 11, wherein said second metal is tungsten and said first metal is osmium.

17. A method of making a thermionic electron emitter comprising the steps of:

(i) providing a porous matrix of a metal selected from the group consisting of tungsten, molybdenum and alloys thereof;

(ii) impregnating the matrix with an alkaline earth activator; and (iii) providing a first metal selected from the group consisting of osmium, iridium, ruthenium, rhodium, rhenium, and alloys thereof and a second metal selected from the group consisting of tungsten, molybdenum and alloys thereof;

(iv) fully alloying said first and second metals and forming a fully alloyed coating as an emissive surface layer on the impregnated matrix, said fully alloyed coating consisting solely of 15 to 45% of said first metal and about 85 to 55% of said first metal, and said fully alloyed coating having said first and said second metal substantially interdiffused therein.

18. A method according to claim 17, wherein said fully alloyed coating is formed by co-sputtering said first and second metals onto said porous matrix.

19. A method according to claim 17, wherein said fully alloyed coating is formed by co-evaporating said first and second metals onto said porous matrix.

20. A method according to claim 17, wherein said fully alloyed coating is formed by co-precipitating said first and second metals onto said porous matrix from reducible compounds of those metals.

21. A method according to claim 17, further comprising the step of forming a layer of said first metal on said matrix prior to forming said fully alloyed coating.

22. A method according to claim 17, further comprising the steps of forming a layer of said first metal on said matrix and causing the metal layer to diffuse into said matrix prior to forming said fully alloyed coating.

23. A method according to claim 22 further comprising the step of forming a further layer of said first metal on said matrix prior to forming said fully alloyed coating.

24. A method according to claim 17, wherein the impregnating step comprises:

(i) forming a reducible impregnation mixture of the said activator and a compound of the a metal selected from the group consisting of osmium, iridium, ruthenium, rhodium, rhenium, and alloys thereof;

(ii) providing a reducing atmosphere; and, (iii) impregnating said matrix using said mixture in said reducing atmosphere whereby said selected metal is released from its compound.

25. A method of making a thermionic electron emitter comprising the steps of:

(i) providing a first metal selected from the group consisting of osmium, iridium, ruthenium, rhodium, rhenium, and alloys thereof and a second metal selected from the group consisting of tungsten, molybdenum and alloys thereof;

(ii) pressing a mixture of 15 to 45% of said first metal with about 85 to 55% of said second metal;

(iii) sintering said mixture to form a porous matrix;

(iv) producing a fully alloyed material consisting solely of said first metal fully alloyed with said second metal by heating said porous matrix, said fully alloyed material having said first and said second metal substantially interdiffused therein; and (v) impregnating said porous matrix with an alkaline earth activator.

26. A method of making a thermionic emitter comprising the steps of:

(i) providing a powder of fully alloyed material comprising 15 to 45% of a first metal selected from the group consisting of osmium, iridium, ruthenium, rhodium, rhenium and alloys thereof and 85 to 55% of a second metal selected from the group consisting of tungsten, molybdenum, and alloys thereof, the particles of the fully alloyed powder having said first and said second metal substantially interdiffused therein;

(ii) placing said powder in a mold;

(iii) pressing said powder;

(iv) sintering the pressed powder to form a porous matrix; and, (v) impregnating said porous matrix with an alkaline earth activator.

27. A method of making a thermionic electron emitter as claimed in claim 25 wherein the heating of said porous matrix takes place at 1800° to 2000° C. for five to ten hours.

* * * * *